US008961706B2

(12) United States Patent
Jerg et al.

(10) Patent No.: US 8,961,706 B2
(45) Date of Patent: Feb. 24, 2015

(54) DISHWASHING MACHINE AND METHOD FOR OPERATING THE SAME

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1184 days.

(21) Appl. No.: 11/792,793

(22) PCT Filed: Oct. 18, 2005

(86) PCT No.: PCT/EP2005/055325

§ 371 (c)(1),
(2), (4) Date: Jun. 6, 2007

(87) PCT Pub. No.: WO2006/061280

PCT Pub. Date: Jun. 15, 2006

(65) Prior Publication Data

US 2008/0149142 A1 Jun. 26, 2008

(30) Foreign Application Priority Data

Dec. 9, 2004 (DE) ..... 10 2004 059 423
Jan. 28, 2005 (DE) ..... 10 2005 004 097

(51) Int. Cl.
*B08B 3/00* (2006.01)
*A47L 15/48* (2006.01)

(52) U.S. Cl.
CPC ..... *A47L 15/481* (2013.01)
USPC ..... 134/57 D

(58) Field of Classification Search
USPC ..... 134/18, 56 D, 57 D, 58 D
See application file for complete search history.

(56) References Cited

U.S. PATENT DOCUMENTS 3,034,221 A * 5/1962 Tuck et al. ..... 34/527
3,126,024 A 3/1964 Jellies
4,023,940 A * 5/1977 Shultz ..... 96/112
4,804,460 A * 2/1989 Moys et al. ..... 209/164

FOREIGN PATENT DOCUMENTS

DE 2 016 831 10/1971
DE 36 26 887 2/1998
EP 0 358 279 3/1990

(Continued)

OTHER PUBLICATIONS

Machine translation of Fried et al. (EP 0358279), Mar. 1990.*

(Continued)

*Primary Examiner* — David Cormier
(74) *Attorney, Agent, or Firm* — James E. Howard; Andre Pallapies

(57) ABSTRACT

A dishwashing machine equipped with a washing compartment and with devices for washing dishes using a washing solution also includes a sorption drying device which is connected to the washing compartment in an air-conducting manner and which comprises a sorption column containing reversibly dehydratable material, this sorption column being used for drying the dishes. To this end, the sorption drying device comprises a sensor that, during the executing of a washing program, serves to detect the state of the reversibly dehydratable material in order to influence the execution of the washing program according to the detected state.

15 Claims, 2 Drawing Sheets

(56) References Cited

FOREIGN PATENT DOCUMENTS

| | | | |
|---|---|---|---|
| EP | 1 344 487 | | 9/2003 |
| EP | 1415588 | A2 * | 5/2004 |
| JP | 4-53522 | | 2/1992 |
| JP | 7-31782 | A | 2/1995 |
| JP | 8-224201 | A | 9/1996 |
| JP | 2002-130944 | A | 5/2002 |
| JP | 2004-200282 | A | 7/2004 |
| WO | WO 98/33427 | | 8/1998 |

OTHER PUBLICATIONS

International Search Report PCT/EP2005/055325, Jun. 15, 2006.

* cited by examiner

DISHWASHING MACHINE AND METHOD FOR OPERATING THE SAME

The invention relates to a dishwashing machine with a washing compartment and devices for washing dishes using washing solution and with a sorption drier which is connected in an air-conducting manner to the washing compartment and a sorption column with reversibly dehydratable material, the sorption column being used to dry the dishes. The invention also relates to a method for operating a dishwashing machine with at least one "Drying" partial programme step in which air is conducted from a washing compartment of the dishwashing machine and/or ambient air is conducted through a sorption column with reversibly dehydratable material into the washing compartment, and moisture is extracted from air as it is conducted through the sorption column.

As is well known, conventional dishwashing machines have a washing process whose programme sequence generally consists of at least one "Prewash" partial programme step, a "Clean" partial programme step, at least one "Intermediate Wash" partial programme step, a "Clear Wash" partial programme step and a "Drying" partial programme step. In order to increase the cleaning effect the washing solution is in this case heated before or during a partial programme step. The washing solution is normally heated by means of electric heating devices. Different drying systems are known for drying the items to be washed in a dishwashing machine.

A dishwashing machine of the type just mentioned is disclosed in DE 20 16 831, in which the air is conducted from the washing compartment via a sealable opening in the wall of the washing compartment on reversibly dehydratable material and from there via an opening to the outside. The desorption of the reversibly dehydratable material takes place during the non-operating phase of the dishwashing machine, the water vapour formed thereby being conducted to the outside via the opening. The dishwashing machine described is disadvantageous from the energy viewpoint because the regeneration of the reversibly dehydratable material takes place during a non-operating phase of the dishwashing machine, i.e. at a time when none of the partial programme steps already described is being carried out. A further disadvantage consists in the fact that the possibility of damage to the surrounding kitchen furniture cannot be ruled out because of the discharge of the water vapour formed during the regeneration of the reversibly dehydratable material to the outside. In this case the regeneration is associated with an additional energy requirement which is added to the energy required during the partial programme steps.

In order to minimise the energy expenditure when operating a dishwashing machine, DE 103 53 774.0 of the applicant discloses a dishwashing machine with a washing compartment and devices for washing dishes by means of washing solution, which dishwashing machine has a sorption column connected in an air-conducting manner to the washing compartment and containing reversibly dehydratable material, wherein on the one hand the sorption column is used to dry the dishes and on the other hand the thermal energy used for desorption of the sorption column is at least partially used for heating the washing solution and/or the dishes.

To solve this same problem DE 103 53 775.9 of the applicant proposes, for operating a dishwashing machine, to conduct air in the at least one "Drying" partial programme step from a washing compartment and/or from ambient air through a sorption column and into the washing compartment, the sorption column containing reversibly dehydratable material and moisture being extracted from the air during its passage.

Heating of the items to be processed is normally no longer necessary in the partial programme step preceding the "Drying" partial programme step due to the use of reversibly dehydratable material with a hygroscopic property, e.g. zeolith. This allows a considerable energy saving.

The object of this invention is therefore to provide a dishwashing machine and a method for operating the same, with which it is possible to clean and dry the items to be washed in the washing compartment efficiently and minimise the associated energy expenditure.

This object is achieved by the dishwashing machine and by the method described herein. Advantageous further developments of this invention are reproduced in the dependent claims.

The dishwashing machine according to the invention is provided with a washing compartment and devices for washing dishes using a washing solution and with a sorption drier which is connected in an air-conducting manner to the washing compartment and has a sorption column with reversibly dehydratable material, wherein the sorption column is used for drying the dishes and wherein a sensor means is provided which serves to record the condition of the reversibly dehydratable material during the course of a washing programme, in order to influence the course of the washing programme independently of this, the sensor means being preferably arranged in the sorption drier. The sensor means may also be arranged outside the sorption drier, e.g. in the washing compartment on the inlet.

Whilst the washing programme sequence of conventional dishwashing machines is subject to time control, the invention proposes arranging a sensor means in the dishwashing machine, more precisely in the sorption drier, in order to adapt a particular partial programme step to the situation, thereby allowing a considerable energy saving. This is particularly the case when the dishwashing machine is operated at only a low load, for example. Both a partial programme step with washing liquid (washing solution) to be heated and the "Drying" partial programme step may be carried out in a short time with the same cleaning and drying effect, respectively, resulting in a saving of energy due to the time saved compared to a time programme control. Shorter times of the partial programme steps are achieved by assessing the condition of the reversibly dehydratable material, in order to influence the course of the washing programme independently of this, e.g. in order to start the next partial programme step or end the "Drying" partial programme step.

In an advantageous design the washing programme comprises at least one "Drying" partial programme step, where the condition of the reversibly dehydratable material can be recorded with the sensor means at least during the "Drying" partial programme step, and where the sensor value or values generated by the sensor means can be transmitted to a control and evaluation device connected to the sensor means, which device is set up or designed to evaluate the sensor value or values and influence the course of the washing programme. Since the "Drying" partial programme step generally takes place at the end of each washing programme, the influencing of the programme sequence consists in termination of the washing programme.

In a suitable design the sensor means is designed as a temperature sensor which is preferably arranged in the sorption drier in such a manner that it is able to record the temperature prevailing in the sorption column or the temperature value prevailing at an output of the sorption column. This procedure is based on the knowledge that the outlet temperature of the air conducted through the sorption drier follows a characteristic curve during drying. For example, if the dishwashing machine is only partially loaded, a little water also adheres to the items to be washed, which must be dried. As soon as the items to be washed and the washing compartment are dry, this is indicated by a fall in the temperature of the air conducted through the sorption drier. When moist air is conducted through the sorption drier, more precisely the sorption column, the latter is heated due to the condensation energy released at high temperatures of up to over 150°. As the drying process continues, the air conducted through the sorption drier receives increasingly less moisture so that less condensation heat is released. This is expressed in a falling temperature of the air escaping from the sorption drier. The temperature curve established here can be assigned to the degree of drying of the items to be washed inside the dishwashing machine just reached.

It is therefore possible to influence the washing programme sequence, i.e. terminate the drying process, on the basis of a value in the control and evaluation device supplied by the sensor means by a comparison with a threshold value. For this purpose the control and evaluation device is set up and designed for comparing the sensor values supplied to the sensor means with a threshold value.

An alternative design provides for the control and evaluation device to record the course of the values supplied by the sensor means over time and to detect the rise in the curve of the sensor values or an inflection point in the rise in the curve as a criterion for influencing the washing programme sequence. In this design the control and evaluation device is set up or designed to record the curve of the sensor values supplied by the sensor means over time and to detect the rise in the curve of the sensor values or an inflection point in the rise in the curve as a criterion for influencing the washing programme sequence.

It is possible to influence the washing programme sequence according to a further design of the invention by designing the sensor means as a humidity sensor. The humidity sensor is preferably arranged in the sorption drier so that it is able to record the humidity in the air flow prevailing at an output of the sorption column. The evaluation in the control and evaluation unit can be carried out on the basis of a comparison of the value supplied by the sensor means in the control and evaluation device with a threshold value. Alternatively, the control and evaluation device may record the curve of the supplies supplied by the sensor means over time and detect the rise in the curve of the sensor values or an inflection point in the rise in the curve as a criterion for influencing the washing programme sequence.

The method according to the invention for operating a dishwashing machine, in particular a domestic dishwashing machine, with at least one "Drying" partial program step in which air is conducted from a washing compartment of the dishwashing machine and/or ambient air is conducted through a sorption column with reversibly dehydratable material into the washing compartment and moisture is extracted from the air during its passage through the sorption column, is characterised in that the temperature of the air conducted through the sorption column is measured in or after the sorption column in order to initiate the end of the "Drying" partial programme step, independently of the measured temperature value or the measured temperature values.

This procedure enables the humidity in the washing compartment to be determined so that the degree of drying, in particular, can be established independently of the load and time so far required.

In a design of the method according to the invention the measured temperature values are compared with a threshold value in order to initiate the termination of the "Drying" partial programme step when the threshold value is exceeded or undershot.

In a further design of the method according to the invention the curve of the measured temperature values over time is recorded and the rise in the curve of the temperature values or an inflection point in the rise in the curve of the temperature values is used as a criterion for terminating the "Drying" partial programme step.

The same advantages can be achieved by a method in which the humidity of the air conducted through the sorption column is measured according to the invention in or after the sorption column in order to initiate the end of the "Drying" partial programme step independently of the measured humidity value or the measured humidity values. This can be initiated correspondingly by a threshold value comparison or monitoring the curve of the humidity values over time.

The invention and its advantages are explained in detail in the following with reference to an exemplary embodiment.

Figure 1:
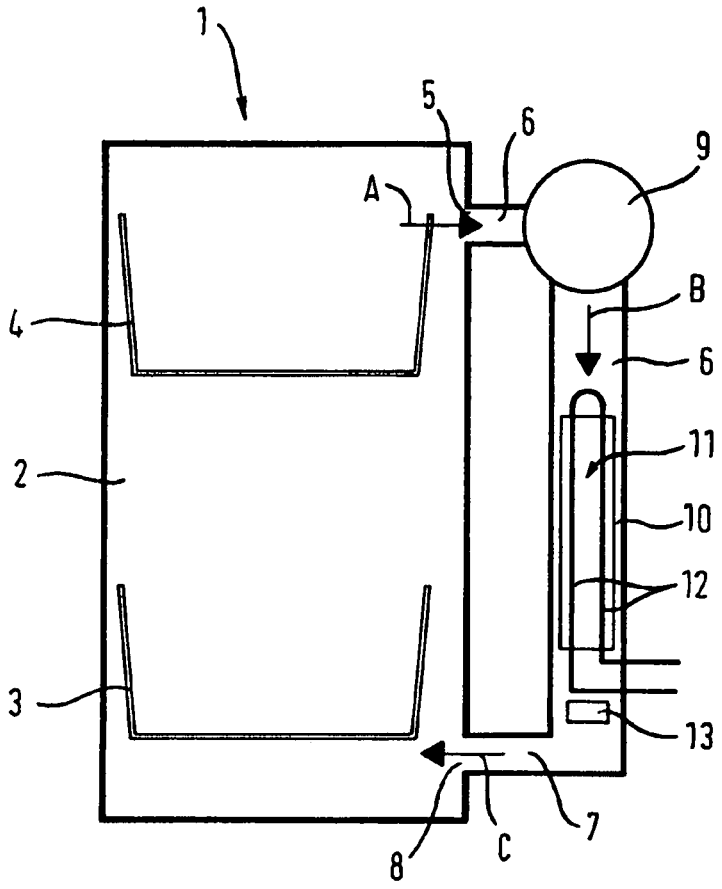
FIG. 1 shows a dishwashing machine according to the invention.

FIG. 1 shows in a diagrammatical representation a dishwashing machine 1 according to the invention, with a washing compartment 2, in which dish baskets 3, 4 are arranged for the insertion of items to be washed, not shown.

Dishwashing machine 1 has a sorption column 10 which is connected in a liquid-conducting manner to washing compartment 2 and contains reversibly dehydratable material 11, e.g. zeolith, sorption column 10, as explained in detail below, is used on the one hand for drying and on the other for heating air conducted through it, as described in particular in DE 103 53 774 and/or DE 103 53 775. The content of these applications is also incorporated in this application if appropriate.

Washing compartment 2 has an outlet 5, arranged in the exemplary embodiment described in its upper region, with a pipe 6 to sorption column 10 and an inlet 8, arranged in the exemplary embodiment described in its lower region, with a pipe 7 from sorption column 10. A fan 9, which supplies air to sorption column 10 from washing compartment 2, is arranged in pipe 6 to sorption column 10.

In an exemplary embodiment shown, an electric heating element 12 is arranged in sorption column 10 for desorption of the reversibly dehydratable material 11. Furthermore, a sensor 13, which may be designed as a temperature or humidity sensor, is arranged in the direction of flow at the output of sorption column 10 for influencing the washing programme sequence, particularly in the "Drying" partial programme step. Alternatively it is also possible to arrange the sensor inside sorption column 10.

As is well known a dishwashing machine has a washing process whose programme sequence consists generally of at least one "Prewash" partial programme step, a "Clean" partial programme step, at least one "Intermediate Wash" partial programme step, a "Clear wash" partial programme step and a "Drying" partial programme step. According to the invention, and in the exemplary example explained, air is conducted through sorption column 10 and back into washing compartment 2 from washing compartment 2 during the "Drying" partial programme step, for which purpose fan 9 is switched on. The air path is denoted by arrows A, B and C. All the moisture is extracted from the air introduced by fan 9 through pipe 6 into sorption column 10 from reversibly dehydratable material 11. In this case the air is heated by the condensation heat of the moisture or the water vapour released in the sorption column, thereby advantageously increasing the moisture absorptivity of the air. The air now heated, e.g. up to 40-70° C., and very dry, is now fed through pipe 7 back into washing compartment 2. The heated air introduced into this compartment is completely dry and because of the higher temperatures has a high moisture heating capacity. It rises in washing compartment 2 and absorbs the residual moisture on the items to be washed. It is now fed back to sorption column 10, as already described above.

Due to the use of reversibly dehydratable material 11 in the "Drying" partial programme step, heating of the items to be washed is not normally necessary in the "Clear wash" partial programme step, which precedes drying. This results in a considerable energy saving. Because of the heating of the air the moisture absorptivity of the air is increased whenever it is conducted through sorption column 10, which results in an improvement in the drying results and a shortening of the drying time.

For desorption of the reversibly dehydratable material air is conducted in the exemplary embodiment explained from washing compartment 2 through sorption column 10 and back into washing compartment 2, in the exemplary embodiment described, during a partial programme step with washing liquid to be heated or, under certain circumstances, already heated washing liquid, preferably during the "Cleaning" and/or "Prewash" partial programme step. For this purpose fan 9 is switched on, as already explained above. The air path is denoted by arrows A, B and C. Furthermore, heating device 12 is switched on in order to carry out the desorption of the reversibly dehydratable material 11.

As is well known, reversibly dehydratable material 11 for desorption is heated to very high temperatures. In this case the stored liquid escapes as hot water vapour. The water vapour is conducted into washing compartment 2 by conducting air by means of fan 9 through pipes 6, 7 according to the air path denoted by arrows A, B and C, and the air is also heated in the washing compartment. The introduction of the hot water vapour and the heated air into washing compartment 2 during the "Clean" partial programme step is quite sufficient to heat the washing solution and/or the dishes adequately. Further heating may therefore be largely dispensed with, and the energy used for desorption can be used almost completely for heating the washing solution and/or the dishes except for the small amount of energy required to overcome the binding forces between the water and reversibly dehydratable material. In addition to the energy saving, efficient cleaning of the items to be washed is therefore also guaranteed.

Figure 2:
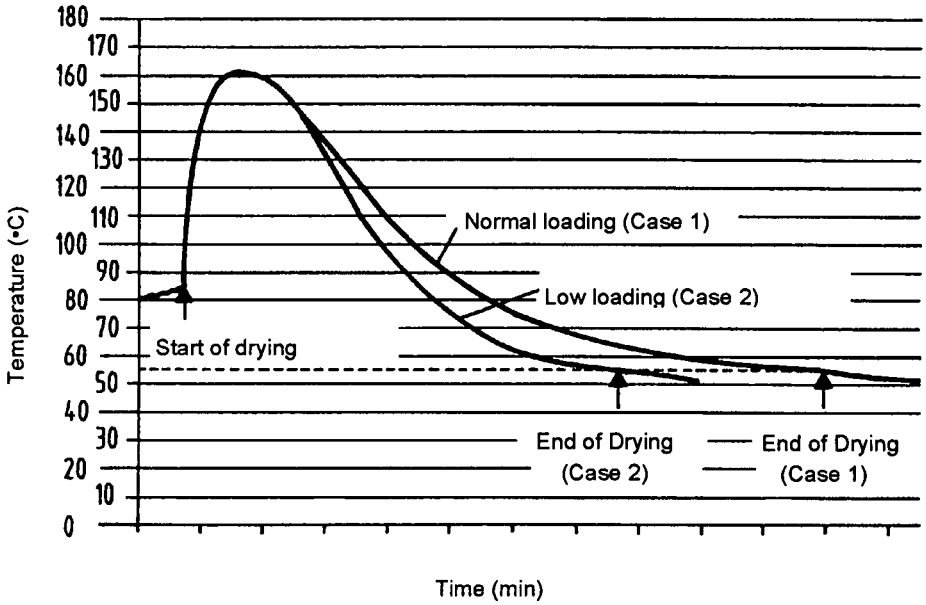
FIG. 2 shows a characteristic temperature curve of the air escaping from a sorption drier.

The energy consumption during the "Drying" partial programme step is caused essentially by the operation of the fan for conducting the air from washing compartment 2 through sorption column 10 and back into the washing container. Here the outlet temperature of the air from the sorption column follows a characteristic temperature curve, which is shown in FIG. 2. Because of the air conducted through sorption column 10, which is initially very moist, a very high condensation heat is generated during dehumidification of the same, thereby heating the reversibly dehydratable material and hence the reversibly dehydratable material and therefore the air conducted through it are heated to temperatures of up to approx. 160° C. As the "Drying" partial programme step progresses the air conducted through sorption column 10 becomes increasingly dry, so that the condensation heat generated in the reversibly dehydratable material is reduced and the air conducted through the sorption column has a lower temperature.

It has been shown here that a certain temperature can be assigned to a certain degree of dryness. In this exemplary embodiment a temperature of approx. 57° C. corresponds to a degree of dryness of approx. 98%. This characteristic temperature, which can be used as a threshold value for comparison with the temperature values determined by the temperature sensor, depends on how the sorption column is formed. Possible factors of influence are in this case the flow resistance of the sorption column, which depends essentially on the diameter of the zeolith balls and the geometric dimensions of the sorption column.

FIG. 2 shows the temperature curves of the air escaping from the sorption column both for the normal load case (Case 1) and for the low load case (Case 2). It can be clearly seen here that in the case of low loading of the dishwashing machine the temperature drops further so that the threshold value (dotted line at approx. 57° C.) is reached at an earlier time. Ultimately this means that the drying process ends more quickly in a low loaded dishwashing machine than in a normally loaded dishwashing machine.

In addition to a threshold value comparison the rise in the curve of the measured temperature can also be used as a criterion for ending the "Drying" partial programme step. It is also possible to detect a characteristic inflection point in the temperature curve.

In another variant, not shown, the humidity measured is used to influence the washing programme sequence instead of the temperature. In this case the procedure corresponds in principle to that just described.

A further shortening of the drying time is achieved when heating of the washing liquid or the items to be washed has taken place in the partial programme step, normally clear washing, preceding the "Drying" partial programme step.

With this invention it is possible to operate dishwashing machines of the type described economically, dry the items to be dried efficiently and minimising the associated energy expenditure due to shortening of the time.

LIST OF REFERENCE SYMBOLS

1 Dishwashing machine
2 Washing compartment
3 Dish basket
4 Dish basket
5 Outlet
6 Pipe
7 Pipe
8 Inlet
9 Fan
10 Sorption column
11 Reversibly dehydratable material
12 Heating element
13 Sensor means
A, B, C Air path

The invention claimed is:

1. A dishwashing machine comprising:

a washing container;

at least one device for washing crockery using a washing solution in accordance with a washing programme;

a sorption drying device communicated with the washing container for the passage of air between the sorption drying device and the washing container, the sorption drying device containing reversibly dehydratable material that operates to withdraw moisture from air during the passage of the air through the sorption drying device in a substantially closed loop "drying" partial programme stage of the washing programme, the stage comprising air exiting from the washing container via a washing container exit outlet, thereafter flowing into the sorption drying device and along a flow path through the sorption drying device, and eventually exiting the sorption drying device to return to the washing container via a washing container entrance inlet; and a sensor to measure a condition of the reversibly dehydratable material at least during the substantially closed loop "drying" partial programme stage of the washing programme, and a control unit to record the at least one measured condition of the reversibly dehydratable material, wherein the control unit is programmed and configured to: (1) correlate the measured condition of the reversibly dehydratable material to a dryness of the crockery in the washing container; and (2) terminate the "drying" partial programme stage of the washing programme if a recorded condition of the reversibly dehydratable material reaches a threshold value.

2. The dishwashing machine according to claim 1, wherein the condition of the reversibly dehydratable material can be recorded with the sensor at least during the "Drying" partial programme step and the sensor values generated by the sensor can be transmitted to a control and evaluation device connected to the sensor, which device is designed to evaluate the sensor values and influence the washing programme sequence.

3. The dishwashing machine according to claim 1, wherein the sensor is designed as a temperature sensor.

4. The dishwasher machine according to claim 3, wherein the temperature sensor is arranged in such a manner that it is able to record the temperature value prevailing in the sorption drying device or the temperature value prevailing at an output of the sorption drying device.

5. The dishwashing machine according to claim 1, wherein the sensor is designed as a humidity sensor.

6. The dishwashing machine according to claim 5, wherein the humidity sensor is arranged in the sorption drying device in such a manner that it is able to record the humidity in the air flow prevailing at an output of the sorption drying device.

7. The dishwashing machine according to claim 1, wherein the control unit further comprises an evaluation device designed to compare the condition values measured by the sensor with the threshold value.

8. The dishwashing machine according to claim 7, wherein the evaluation device is designed to record the curve of the condition values supplied by the sensor over time and to detect a selected one of the rise in the curve of the condition values and an inflection point in the rise in the curve as a criterion for influencing the washing programme sequence.

9. A method for operating a dishwashing machine comprising:

during a substantially closed loop "drying" partial programme step, conducting air from at least one of a washing container and an ambient air source through a sorption drying device containing reversibly dehydratable material that operates to withdraw moisture from air during the passage of the air through the sorption drying device; and extracting moisture from the air during the passage of the air through the sorption drying device;

measuring a temperature of the air conducted through the sorption drying device in the substantially closed loop during at least one of passage of the air inside the sorption drying device and after the air has exited the sorption drying device but before the air has passed to the washing container via a sensor disposed in the sorption drying device proximate to a washing container entrance inlet using a sensor;

recording the measured temperature of the air with a control unit;

correlating the measured temperature of the air conducted through the sorption drying device to a dryness of crockery in the washing container using the control unit; and initiating an end of the "drying" partial programme step as a function of the measured temperature of the air using the control unit.

10. The method according to claim 9, wherein the sensed temperature values are compared with a threshold value using an evaluation device associated with the control unit in order to initiate a termination of the "Drying" partial programme step if a selected one of at least an event occurs wherein the threshold value is exceeded and the threshold value is undershot.

11. The method according to claim 9, wherein the curve of the sensed temperature values over time is recorded and a selected one of the rise in the curve of the temperature values and an inflection point in the rise in the curve of the temperature values is used as a criterion for termination of the "Drying" partial programme step.

12. A method for operating a dishwashing machine comprising:

during a substantially closed loop "drying" partial programme step, conducting air from at least one of a washing container and an ambient air source through a sorption drying device containing reversibly dehydratable material that operates to withdraw moisture from air during the passage of the air through the sorption drying device; and extracting moisture from the air during the passage of the air through the sorption drying device;

measuring a humidity characteristic of the air conducted through the sorption drying device in the substantially closed loop during at least one of passage of the air inside the sorption drying device and after the air has exited the sorption drying device but before the air has passed to the washing container via a sensor disposed in the sorption drying device proximate to a washing container entrance inlet using a sensor;

recording the measured humidity of the air with a control unit;

correlating the measured humidity of the air conducted through the sorption drying device to a dryness of crockery in the washing container with the control unit; and initiating an end of the "drying" partial programme step as a function of the measured humidity of the air using the control unit.

13. The method according to claim 12, wherein the measured humidity values are compared with a threshold value using an evaluation device associated with the control unit in order to initiate a termination of the "Drying" partial programme step when a selected one of at least an event where the threshold value is exceeded and an event where the threshold value is undershot.

14. The method according to claim 12, wherein the curve of the measured humidity values over time is recorded and a selected one of the rise in the curve of the humidity values and an inflection point in the rise in the curve of the humidity values is used as a criterion for termination of the "Drying" partial programme step.

15. A dishwashing machine comprising:

a washing container;

at least one device for washing crockery using a washing solution in accordance with a washing programme;

a sorption drying device communicated with the washing container for the passage of air between the sorption drying device and the washing container in a substantially closed loop during a "drying" partial programme stage of the washing programme, wherein air exits from the washing container via a washing container exit outlet, thereafter flowing into the sorption drying device and along a flow path through the sorption drying device, and eventually exits the sorption drying device to return to the washing container via a washing container entrance inlet, the sorption drying device containing reversibly dehydratable material that operates to withdraw moisture from air during the passage of the air through the sorption drying device; and a sensor to obtain at least one measured value of the air passing through the sorption drying device and re-entering the washing container, the sensor disposed in the sorption drying device proximate the washing container entrance inlet, and the measured value being a temperature and/or a humidity;

a control unit to record the at least one measured value of the air passing through the sorption drying device;

wherein:

the control unit is programmed and configured to: (1) correlate the measured value of the air, which corresponds to a condition of the reversibly dehydratable material, to a dryness of the crockery in the washing container; and (2) terminate the drying partial programme stage when the temperature and/or humidity of the air reaches a pre-determined threshold value, and wherein an initial temperature and/or humidity value is greater than the predetermined threshold value.

* * * * *